United States Patent [19]

Gritti

[11] 4,115,291

[45] Sep. 19, 1978

[54] LIQUID COMPOSITIONS BASED ON POLYGLYCOLETHERS HAVING A HIGH BOILING POINT

[75] Inventor: Sergio Gritti, Genthod-Geneve, Switzerland

[73] Assignee: Montedison S.p.A., Milan, Italy

[21] Appl. No.: 446,790

[22] Filed: Feb. 28, 1974

Related U.S. Application Data

[62] Division of Ser. No. 167,035, Jul. 28, 1971, Pat. No. 3,991,122.

[30] Foreign Application Priority Data

Jul. 31, 1970 [IT] Italy ..... 28130 A/70

[51] Int. Cl.[2] ..... C10M 3/16; C10M 3/14

[52] U.S. Cl. ..... 252/73; 260/61 B

[58] Field of Search ..... 252/73; 260/615 B

[56] References Cited

U.S. PATENT DOCUMENTS

| | | | |
|---|---|---|---|
| 2,425,755 | 8/1947 | Roberts et al. | 260/615 B |
| 3,062,747 | 11/1962 | Fife et al. | 252/73 |
| 3,324,035 | 6/1967 | Nankee et al. | 252/73 |
| 3,472,781 | 10/1969 | Ziemba | 252/73 X |

FOREIGN PATENT DOCUMENTS

| | | |
|---|---|---|
| 622,240 | 6/1961 | Canada. |
| 616,256 | 1/1949 | United Kingdom. |
| 850,990 | 10/1960 | United Kingdom. |

*Primary Examiner*—Harris A. Pitlick

*Attorney, Agent, or Firm*—Stevens, Davis, Miller & Mosher

[57] ABSTRACT

A process is disclosed for the preparation of monoalkyl ethers of polyoxyalkyleneglycols having a boiling point greater than 290° C and suitable for use as a hydraulic brake fluid, wherein a mixture of ethylene oxide and propylene oxide is reacted in an anhydrous alkaline medium, and at elevated temperatures and with a monoalkylether of diethylene glycol, in a preferred weight ratio oxides/glycol-ether comprised between 1.2 and 1.8. Preferably, the monoalkylether of diethylene glycol is the monomethylether which may contain a small amount of monoethylene glycol. The reaction product may be adjusted as regards viscosity by dilution with a minor amount of an alkoxy triglycol, e.g., butoxy triethyleneglycol.

7 Claims, No Drawings

LIQUID COMPOSITIONS BASED ON POLYGLYCOLETHERS HAVING A HIGH BOILING POINT

This is a division of application Ser. No. 167,035, filed July 28, 1971, now U.S. Pat. No. 3,991,122.

The present invention relates to liquid compositions especially suited for use as power transmission fluids, and consisting essentially of one or more monoalkylethers of polyoxalkyleneglycols characterized by a molecular weight of about 300 and by a normal boiling point greater than 290° C. The invention also relates to a process for the preparation of such liquid compositions.

The monoalkyl polyoxalkyleneglycol ethers are per se known compounds that have been directly applied in the field of power transmission fluids. In general, they are prepared by reacting an aliphatic monofunctional alcohol such as methanol or ethanol, or monoethers of ethylene glycol or propylene glycol of the above said aliphatic alcohols, with one or more alkylene oxides, preferably ethylene oxide and propylene oxide, in an anhydrous alkaline medium at 120°–150° C and under a pressure of from 3 to 10 atmospheres.

The alkylene oxides may be introduced into the reactor in the form of a mixture or separately, one after the other; in this latter case the addition reaction between the monofunctional alcohol and the first alkylene oxide must be accomplished (discharging of the excess reactants, restoring of the optimal conditions of alkalinity, etc.) before starting the subsequent loading of the successive alkylene oxide.

Notwithstanding the various operational techniques heretofore suggested, the preparative methods so far adopted have the drawback of not being capable of producing directly anything except mixtures of products having a wide distribution of molecular weights, and not possessing the boiling point and viscosity characteristics at present demanded by the modern requirements for power transmission fluids, for instance for hydraulic brakes, used under increasingly severe operational conditions.

In order to eliminate heavy residues or volatile fractions for the purpose of achieving a greater homogeneity of physical characteristics, the mixtures thus prepared require further treatment such as rectification which therefore further complicates the preparation process.

It has now, surprisingly, been found, and this forms the object of this invention, that monoalkylethers of polyoxalkyleneglycols, characterized by a molecular weight between 270 and 300, by a normal boiling point greater than 290° C, and by a maximum viscosity of 1800 cSt at −40° C, may be prepared by adding, in an anhydrous alkaline medium at 120°–150° C and under a pressure of 3–10 atmospheres, from 1.2 to 1.8 parts by weight of a mixture of alkylene oxides, preferably ethylene oxide and propylene oxide in a weight ratio between 30:70 and 45:55 to 1 part by weight of a monoalkylether of diethylene glycol.

For the preparation of the poly-addition products of this invention one uses conveniently, as raw material, the monomethylether of diethylene glycol:

$$CH_3-O-CH_2-CH_2-O-CH_2-CH_2-OH$$

which, as is well known, is recovered by fractional distillation from the raw mixture obtained by adding ethylene oxide to methanol. As the heart cut of the fractional distillation, the product in question is free of the more volatile fractions represented by the monomethylether of monoethylene glycol, and of the heavier fractions such as the monomethylether of triethylene glycol.

A further advantage of the preparative process of this invention is that the physical and technical characteristics may be achieved with a much greater operational ease and economical convenience, starting from monomethylether of diethylene glycol containing some ethyleneglycol. As is well known, the ethyleneglycol is produced by hydration of ethylene oxide. Thus if, during the preparation of the monomethylether of diethylene glycol, water is present, there will be produced the corresponding stoichiometric quantity of ethyleneglycol.

Likewise, it is well known that the ethyleneglycol forms with the monomethylether of the diethylene glycol azeotropes having boiling points only slightly lower than that of the monomethylether of pure diethylene glycol (193.2° C.).

During the fractional distillation of the mixture of the addition products methanol/ethylene oxide, the "monomethylether of the diethylene glycol" fraction to be subjected to the subsequent addition with the mixture of ethylene and propylene oxides according to this invention, will thus consist of a mixture of monomethylether of diethylene glycol and of ethyleneglycol, in which mixture the ethyleneglycol will be present in a controlled quantity, depending on the quantity of water present at the start. In the following description this fraction will be called "glycol-ether".

Thus, the process of this invention, by which one obtains polyaddition products consisting of monoalkylethers of polyoxyalkylenglycols, is carried out by reacting from 1.2 to 1.8 parts by weight of a mixture of ethylene and propylene oxides with 1 part by weight of monomethylether of diethylene glycol containing from 0 - 6% by weight of ethyleneglycol.

The polyaddition products obtained according to the present invention have viscosities (at −40° C) that increase with increasing ethyleneglycol content of the "glycol-ether" fraction. The alkylene oxides, as a matter of fact, react also with the ethyleneglycol that possibly may be contained in the monomethylether of the diethylene glycol, forming addition products that have two free hydroxyl groups having a viscosity (at −40° C) greater than that of the addition products formed by the reaction of the methylether of the diethylene glycol with the same boiling point.

Now it has been found experimentally that, as long as the content of ethyleneglycol is low (0 - 3%), the weight ratio alkylene oxides/glycol-ether will not influence the viscosity of the product obtained. As a matter of fact, by operating with a ratio '*m*' between 1.2 and 1.8, the product of the polyaddition reaction on the methylether of diethylene glycol containing 0 - 3% of ethyleneglycol, has a maximum viscosity of 1800 cSt at −40° C, and a boiling point of from 290° to 310° C.

These polyaddition products, thanks to their particular physical and chemical-physical characteristics, are suitable for use directly as power transmission fluids, as for instance hydraulic brake fluids. On the other hand, when the ethyleneglycol is present in a higher concentration (3 - 6%) in the glycol-ether fraction, the product of the polyaddition is still directly usable as a fluid for hydraulic brakes only when the $m$ ratio is between 1.2 and 1.5.

The preparative process of this invention has also been worked out for the case in which ethyleneglycol is present to the extent of 3 - 6% and in which the alkylene oxides/glycol-ether ratio is between 1.5 and 1.8. When operating under these conditions, the polyaddition product is not directly usable as hydraulic brake fluid in as much as one of the basic characteristics, the viscosity, shows values that are too high in comparison to the specified limit of 1800 cSt at −40° C. However, it has also been discovered, and this forms another object of the present invention, that the difficulty just mentioned may be overcome by diluting the product of polyaddition by means of a high boiling solvent of the alkoxytriglycol type in which the alkoxy group has from 1 to 4 carbon atoms, such as: methoxytriglycol, ethoxytriglycol, butoxytriglycol, in quantities between 10 to 20% by weight based on the finished product, so that the viscosity of the product of the polyaddition, which is initially greater than 1800 cSt at −40° C, shall thereby be reduced to below that limit.

The following examples are given for purely illustrative and non-limiting purposes.

EXAMPLE 1

Monomethylether of diethyleneglycol having 2.3% of monoethylene glycol is reacted, at 130° C and at 5 atmospheres and in the presence of 0.03% KOH (by weight, calculated on the end product), with an ethylene oxide/propylene oxides mixture having a 35:65 by weight ratio. The weight ratio alkylene oxides/ether-glycols equals 1.35.

The polyaddition reaction product, after neutralization, filtering through diatomite and drying, is a liquid with a boiling point of 300° C, a viscosity of 1640 cSt at −40° C, and having a GRS rubber swelling of 1.1 mm, eminently suited for use as a working fluid for hydraulic brakes.

EXAMPLE 2

Operating according to the same procedures described in Example 1, but using an alkylene oxides/-glycol-ether ratio = 1.42, one obtains a polyglycolether with a boiling point equal to 305° C, a viscosity at −40° C of 1700 cSt, and having a GRS rubber swelling of 1.1 mm.

EXAMPLE 3

In this instance the procedure of Example 1 was repeated but using a different weight ratio ethylene oxide/propylene oxide, that is, a 40/60 ratio.

There was obtained a liquid product which had the same characteristics of that of Example 1.

EXAMPLE 4

With the same operational conditions of Example 1, and with an ethylene glycol content of 3% by weight, there was carried out an addition reaction at a ratio of 1.34 between the alkylene oxides and the glycol-ether.

The product thus obtained had a viscosity of 1626 cSt at −40° C, a boiling point of 297° C, and a GRS rubber swelling of 1 mm.

EXAMPLE 5

Using an oxides ratio of 35:65, and with a weight ratio of alkylene oxides/glycol-ether of $m$ = 1.37, the same procedure of Example 1 was repeated but using a monomethylether of diethylene glycol having 0.5% of monoethylene glycol.

The resulting liquid showed a boiling point of 303° C, a viscosity at −40° C = 1630 cSt, and a GRS rubber swelling of 1.1 mm.

EXAMPLE 6

Operating under the same conditions as those described above in Example 5 but with $m$ = 1.35, there were obtained polyglycol-ethers having viscosity values practically equal to each other (1620 cSt) as well as equal boiling temperatures (299° C).

EXAMPLES 7 - 8

Carrying on the tests with the 35/65 mixture of alkylene oxides and operating under the same conditions as in Example 1, with a monomethylether of diethylene glycol having 1.2% of monoethyleneglycol, and with $m$ = 1.36, the liquid products thus obtained showed the following characteristics:

| | Example 7 | Example 8 |
|---|---|---|
| Boiling point at 760 mm | 298° C | 301° C |
| Viscosity at −40° C | 1650 cSt | 1630 cSt |
| CRS rubber swelling | 1.1 mm | 1.1 mm |

EXAMPLES 9 - 11

Operating according to the conditions described above in Example 1, a 40/60 alkylene oxides mixture was added at ratios for m very near the upper valus of the preferred range, to a monomethylether of diethylene glycol having a relatively high content of monoethylene glycol.

The results of these tests are recorded on the following table:

TABLE

| Examples: | | 9 | 10 | 11 |
|---|---|---|---|---|
| Contents of monoethylene glycol, % b. w. | | 4.5 | 5.5 | 5.8 |
| m ratio | | 1.6 | 1.6 | 1.7 |
| Product: | | | | |
| Boiling point at 760 mm, | ° C | 302° | 308° | 315° |
| Viscosity at −40° C | cSt | 3420 | 2500 | 2400 |
| GRS rubber swelling | in mm | 1 | 1 | 1 |

EXAMPLE 12

This test was carried out under the conditions described above in Example 1, but with a quantity of monoethylene glycol in the monomethylether of diethyleneglycol of 4.5% and with a weight ratio of alkylene oxides/glycol-ether of 1.6. By diluting the reaction product with butoxy-triglycol a final composition was obtained that contained: 90 parts by weight of polyglycol-ether and 20 parts by weight of butoxy-triglycol.

The physical and technological characteristics of the final composition were:

| | |
|---|---|
| Boiling point | 298° C |
| Viscosity at −40° C | 1718 cSt |
| GRS rubber swelling | 1 mm |

EXAMPLE 13

The test of Example 1 was repeated but with the following modifications:

| | |
|---|---|
| monomethylene glycol content in % | 5.8% |
| alkylene oxides/glycol-ether ratio (m) | 1.7% |
| polyglycol-ether, parts by weight | 90 |
| butoxy-triglycol, parts by weight | 10 |

A composition was thereby obtained which, like the preceding ones, was well suited for use as a hydraulic brake fluid and had the following characteristics: boiling point = 301° C; viscosity at −40° C = 1780 cSt.

EXAMPLES 14 - 17

These tests were carried out under the same operational conditions as Example 1, above, but changing both the monoethyleneglycol content of the "glycol-ether" fraction as well as the ratio alkylene oxides/-glycol-ether according to the values reported in the following table, in which are also recorded the physical and technological characteristics of the polyglycol-ethers obtained:

| | Examples | | | |
|---|---|---|---|---|
| | 14 | 15 | 16 | 17 |
| monoethylene glycol content in % by weight | 0.5 | 1.2 | 4.5 | 5.8 |
| weight ratio: alkylene oxides/ glycol-ethers | 1.6 | 1.7 | 1.35 | 1.37 |
| weight ratio: $\frac{\text{ethylene oxide}}{\text{propylene oxide}}$ | 35/65 | 35/65 | 40/60 | 40/60 |
| characteristics of the produced polyglycol ether: | | | | |
| boiling point at 760 mm Hg, °C | 307 | 309 | 296 | 298 |
| viscosity at −40° C, in cSt | 1720 | 1715 | 1740 | 1750 |

What is claimed is:

1. A process for the preparation of monoalkylethers of polyoxyalkyleneglycols, having a maximum viscosity of 1800 cSt at −40° c, an average molecular weight between 270 and 300, and a boiling point of from 290° to 310° C, wherein a mixture of ethylene oxide and propylene oxide in a weight ratio between 30:70 and 45:55 is reacted at 120°-150° C and under a pressure of from 3 to 10 atmospheres, and in an anhydrous alkaline medium catalyst, with a monoalkylether of diethylene glycol containing ethylene glycol, in a weight ratio: alkylene oxide/glycol-ether between 1.5 and 1.8 and thereafter diluting the product of the polyaddition with an alkoxy-triglycol, the alkoxy group of which has 1-4 carbon atoms, until the desired viscosity is obtained.

2. A process according to claim 1, wherein the monoalkylether of diethylene glycol is the monomethylether.

3. A process according to claim 2, wherein the monomethylether of diethylene glycol contains from 3-6% by weight of monoethylene glycol.

4. A liquid composition suited for use as an hydraulic brake fluid, having a boiling point between 290° and 310° C., a maximum viscosity of 1800 cSt. at −40° C., and consisting essentially of:

(a) 80-100% by weight of the monoalkylether of polyoxyalkylene glycol with an average molecular weight between 270 and 300 obtained by reacting a mixture of ethylene oxide and propylene oxide in a weight ratio between 30:70 and 45:55, with a monoalkylether of diethylene glycol, in a weight ratio of alkylene oxides/glycol ether between 1.2 and 1.8 in the presence of an alkaline catalyst, at 120°-150° C. under a pressure of from 3 to 10 atmospheres, and (b) 0-20% by weight of an alkoxy-triglycol, the alkoxy group having from 1 - 4 carbon atoms.

5. A liquid composition according to claim 4 wherein the alkoxy-triglycol is butoxy-triethyleneglycol.

6. The composition of claim 4 wherein said monoalkylether of diethylene glycol is the monomethylether of diethylene glycol.

7. The composition of claim 6 wherein said monomethylether of diethylene glycol contains from 0-6% by weight of monoethylene glycol.

* * * * *